US009581394B2

(12) United States Patent
Jensen et al.

(10) Patent No.: US 9,581,394 B2
(45) Date of Patent: Feb. 28, 2017

(54) AMMONIA HEAT EXCHANGER UNIT AND SYSTEM

(71) Applicant: Raven Industries, Inc., Sioux Falls, SD (US)

(72) Inventors: Steve S. Jensen, Sioux Falls, SD (US); Patrick A. Hansen, Tea, SD (US); Warren L. Thompson, Baltic, SD (US); Nicholas O. Michael, Sioux Falls, SD (US)

(73) Assignee: Raven Industries, Inc., Sioux Falls, SD (US)

( * ) Notice: Subject to any disclaimer, the term of this patent is extended or adjusted under 35 U.S.C. 154(b) by 298 days.

(21) Appl. No.: 14/523,098

(22) Filed: Oct. 24, 2014

(65) Prior Publication Data

US 2015/0114610 A1 Apr. 30, 2015

Related U.S. Application Data

(60) Provisional application No. 61/895,703, filed on Oct. 25, 2013.

(51) Int. Cl.

| | |
|---|---|
| ***F28F 13/12*** | (2006.01) |
| ***F28F 1/12*** | (2006.01) |
| ***F28D 7/10*** | (2006.01) |
| ***F28D 7/12*** | (2006.01) |
| ***F28F 1/36*** | (2006.01) |
| *F28F 9/22* | (2006.01) |
| *F28D 21/00* | (2006.01) |

(52) U.S. Cl.

CPC ..... *F28F 1/12* (2013.01); *F28D 7/106* (2013.01); *F28D 7/12* (2013.01); *F28F 1/36* (2013.01); *F28F 13/12* (2013.01); *F28D 2021/0098* (2013.01); *F28F 2009/228* (2013.01)

(58) Field of Classification Search

CPC ..... F28F 1/12; F28F 1/36; F28F 13/12; F28F 2009/228; F28D 7/106; F28D 7/12; F28D 2021/0098

USPC .... 165/109.1, 104.11, 177, 180, 182, 104.19

See application file for complete search history.

(56) References Cited

U.S. PATENT DOCUMENTS 2,452,391 A * 10/1948 O'Sullivan ..... F28D 7/06 165/143

2,706,106 A * 4/1955 Roswell ..... F28D 7/12 165/142

(Continued)

*Primary Examiner* — Justin Jonaitis

(74) *Attorney, Agent, or Firm* — Schwegman Lundberg & Woessner, P.A.

(57) ABSTRACT

A heat exchange unit for a heat exchanger system includes a heat exchange tube. The heat exchange tube including a heat exchange tube inlet and one or more heat exchange fins coupled along the heat exchange tube. The heat exchange tube extends from the heat exchange tube inlet to a refrigerant return. A heat exchange jacket is interposed between the heat exchange tube and a unit housing. The heat exchange jacket includes a jacket passage in communication with the refrigerant return. A first product passage extends from the product inlet to a product return. The heat exchange fins turbulate agricultural product in the first product passage while heat is transferred from the agricultural product to refrigerant in one or more of the heat exchange tube or the heat exchange jacket. Heat is transferred from the agricultural product to the refrigerant through the heat exchange jacket in the second product passage.

34 Claims, 10 Drawing Sheets

(56) References Cited

U.S. PATENT DOCUMENTS

| | | | | |
|---|---|---|---|---|
| 4,458,609 | A * | 7/1984 | Tofte | F28D 7/103 111/119 |
| 6,269,757 | B1 * | 8/2001 | Kiest | A01C 23/024 111/119 |
| 7,096,802 | B1 * | 8/2006 | Kiest | A01C 23/024 111/119 |
| 8,631,828 | B1 * | 1/2014 | Ward | B01F 5/0268 137/561 A |
| 2011/0083619 | A1 * | 4/2011 | Master | F22B 1/16 122/32 |

* cited by examiner

AMMONIA HEAT EXCHANGER UNIT AND SYSTEM

CLAIM OF PRIORITY

This patent application claims the benefit of priority to U.S. Provisional Patent Application Ser. No. 61/895,703, filed on Oct. 25, 2013, which is hereby incorporated by reference in its entirety.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to the software and data as described below and in the drawings that form a part of this document: Copyright Raven Industries; Sioux Falls, S. Dak. All Rights Reserved.

TECHNICAL FIELD

This document pertains generally, but not by way of limitation, to heat exchangers for use with agricultural products.

BACKGROUND

Agricultural applications of anhydrous ammonia are in some examples provided by way of an applicator including a series of knives (or coulters) and dispensing orifices associated with each of the knives. The ammonia is dispensed in a liquid or gaseous form into the cuts formed by the knives. The anhydrous ammonia is stored in one or more tanks, and the tanks are pulled in an implement train including, for instance, a prime mover such as a tractor, the applicator, and an ammonia tender. The vapor pressure within the tanks gradually decreases as ammonia is drawn from the tanks. The decrease in vapor pressure allows the remaining ammonia to transition from a liquid phase to a liquid and vapor phase. As the ammonia within the tanks is depleted the remaining ammonia transitions further toward a vapor phase.

For the proper application of anhydrous ammonia, liquid ammonia is desired for delivery to the dispensing orifices and deposition within the cut soil. Heat exchanger systems are used (e.g., on the applicator) to cool the ammonia and transition the vapor and liquid mixture toward a liquid phase. In some examples, the heat exchangers deliver a refrigerant (for instance recycle ammonia) through a linear tube extending through a passage for the ammonia. Heat transfer between the linear tube and the ammonia cools the ammonia and transitions the vapor component of the mixture toward the liquid phase. The ammonia is delivered to a distributor (e.g., with a pump), and from the distributor to the dispensing manifolds or orifices on the applicator. In another example, a series of vertical dams or baffles are provided in the ammonia passage to facilitate heat transfer with a serpentine flow of the ammonia.

OVERVIEW

The present inventors have recognized, among other things, that a problem to be solved can include decreasing heat exchange inefficiencies in agricultural product heat exchanger systems, and conversely increasing the efficiency of heat exchange. For instance, for a desired change in temperature (delta T) it is desired to increase the flow rate of agricultural product while maintaining the needed change in temperature. In another example, for a desired change in temperature and a static flow rate of agricultural product it is desired to decrease power needed for the heat exchanger system including power needed to cool a refrigerant, pump the refrigerant and the like.

In an example, the present subject matter can provide a solution to this problem, such as by the use of a heat exchange unit including first and second product passages. A heat exchange tube including one or more heat exchange fins extends along the first product passage. A heat exchange jacket in communication with the heat exchange tube through a refrigerant return extends along the first product passage and the second product passage. The one or more heat exchange fins turbulate the flow of the agricultural product within the first product passage and accordingly disrupt boundary layers otherwise present along the heat exchange tube and the heat exchange jacket (e.g., an interior layer of the jacket). Heat transfer is thereby more efficiently provided in the first product passage between the refrigerant and the agricultural product because of the turbulent flow along each of the tube and jacket features, and through heat transfer along the one or more heat exchange fins (that provide additional surface area beyond the heat exchange tube). Heat transfer continues for the agricultural product after redirection into the second product passage with a product return and continued cooling with the heat exchange jacket (e.g., an exterior layer of the jacket). Further, the tortuous path defined by the one or more heat exchange fins increases the dwell time within the heat exchange unit (relative to straight pass heat exchange units) and correspondingly increases the amount of heat transfer between the agricultural product and the refrigerant while in the heat exchange unit.

In another example, one or more expansion zones are provided in a refrigerant circuit including a heat exchange delivery line, the heat exchange tube, the refrigerant return, and the heat exchange jacket. The one or more expansion zones sequentially facilitate expansion of the refrigerant with corresponding cooling of the refrigerant to enhance heat transfer (cooling) from the agricultural product. For instance, expansion zones are provided at one or more of the heat exchange delivery line, an interface of the delivery line and an inlet for the heat exchange tube, an interface between one or more of the heat exchange tube and the refrigerant return and the refrigerant return and the heat exchange jacket (as well as a refrigerant collection reservoir).

The examples described above, provide more efficient heat exchange between the ammonia and the refrigerant than comparable tube based and dam or baffle based heat exchangers. The systems described herein provide a heat exchange unit that provides improved cooling to an agricultural product, such as anhydrous ammonia, while maintaining the heat exchange unit in an identical (including identical or substantially identical) footprint to other less efficient heat exchange units. In one example, the exemplary heat exchange unit realizes a 100 percent advantage corresponding to a doubled flow rate of agricultural product while maintaining the desired change in temperature between the product inlet and outlet of the heat exchange unit. Alternatively or in addition, the heat exchanger system (cooling of the refrigerant, pump, and the like) are operated with less power input while maintaining a desired flow rate of agricultural product with the desired change in temperature.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
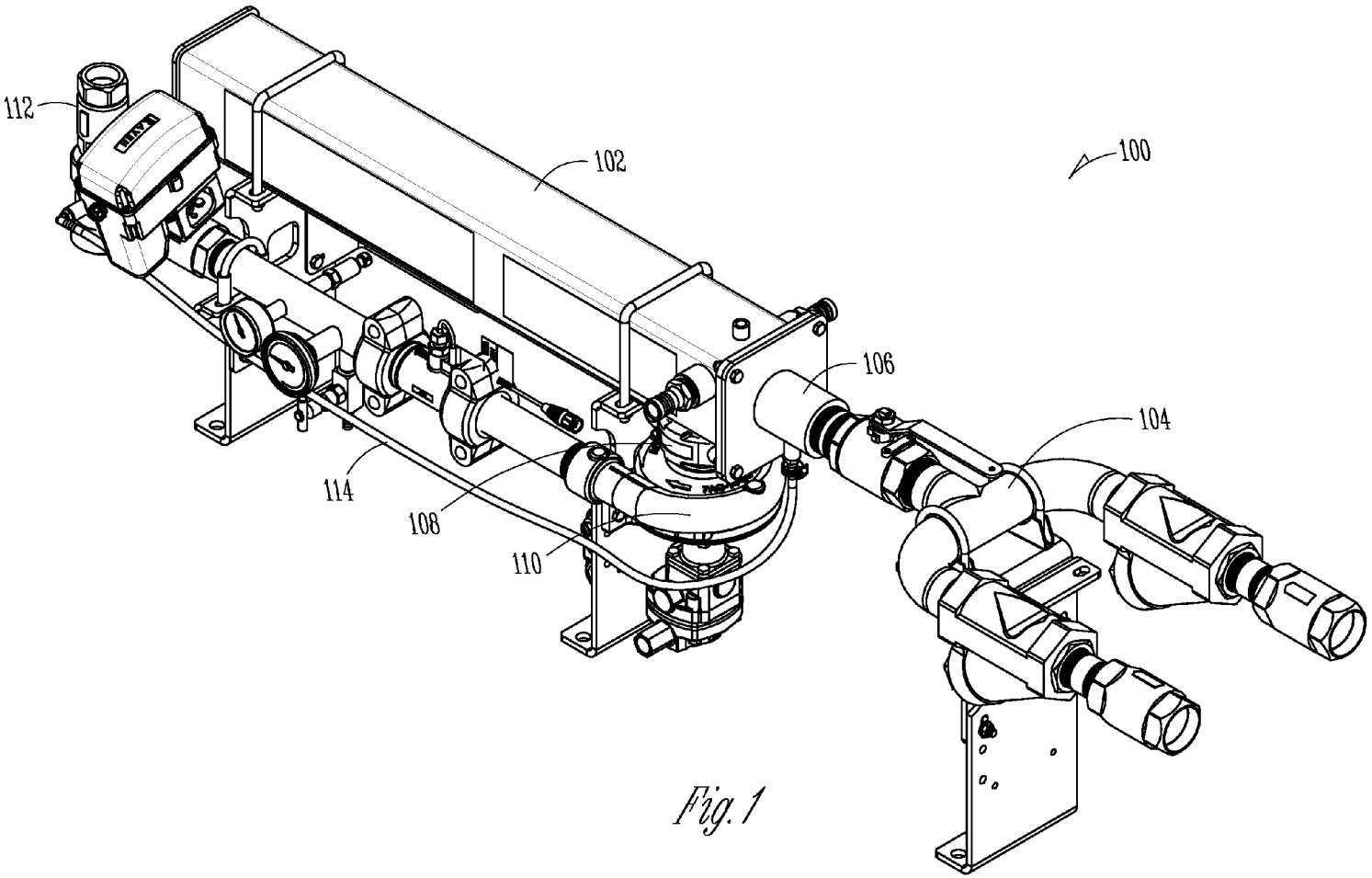
FIG. 1 is a perspective view of one example of a heat exchanger system including a heat exchange unit.
Figure 6A:
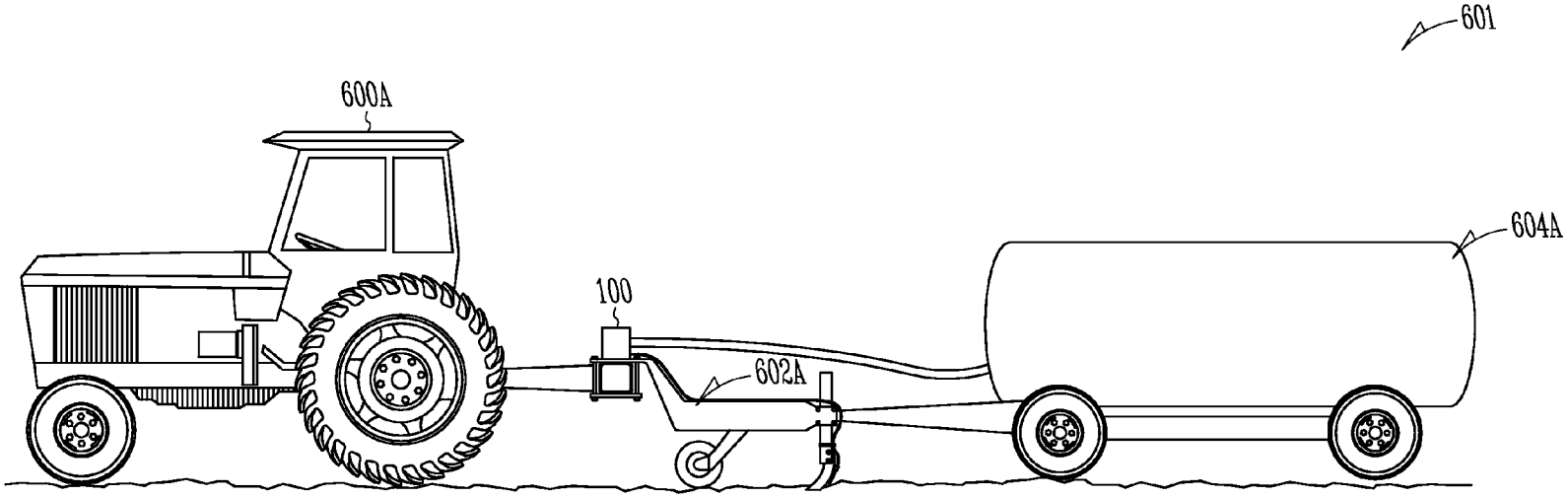
FIG. 6A is a schematic diagram of one example of a vehicle train including a prime mover, an applicator and a product tender.

FIG. 1 shows a perspective view of one example of a heat exchanger system 100. The heat exchanger system 100 is used in combination with an applicator (examples of applicators are described herein). The heat exchanger system 100 is used to lower the temperature of an agricultural product (e.g., anhydrous ammonia or the like) to facilitate its application in a liquid form. Stated another way, the heat exchanger system 100 decreases the temperature to facilitate a phase transformation (e.g., from gas to liquid) to ensure the delivery of the agricultural product in a liquid form (entirely liquid or substantially liquid form). The delivery of agricultural product in liquid form is beneficial because it is a more efficient way to deliver the agricultural product to the soil, such that the agricultural product is delivered to the soil instead of lost to the surrounding atmosphere. Further, the phase transformation of the agricultural product by the heat exchanger system 100 allows easy measurement of the flow rate of the agricultural product by a flow meter and metering through a control valve. In one example, the heat exchanger system is used in combination with a vehicle based agricultural sprayer as the applicator. In another example, the heat exchanger system 100 is used in combination with a vehicle train including a product tender, an applicator, and a prime mover. One example of a vehicle train is shown in FIG. 6A.

The heat exchanger system 100 includes a heat exchange unit 102 provided as a component of the heat exchanger system 100. For instance, as shown in FIG. 1, a manifold 104 is in communication with the heat exchange unit 102. The manifold 104 is in turn coupled with a source of the agricultural product, such as ammonia. In an example with ammonia as the agricultural product the ammonia is delivered through the manifold 104 to a product inlet 106 of the heat exchange unit 102 for instance in a vapor mixture of gas and liquid components (the proportion of gas to liquid changes according to product temperature and pressure varying based on ambient temperature and the fill level of a product tank)). As further shown in FIG. 1 a product outlet 108 is provided with the heat exchange unit 102. The product outlet 108 facilitates the delivery of the (cooled) agricultural product to other features of the system including, but not limited to, a pump 110 in communication with a distributor 112 configured to deliver the agricultural product to one or more applicators (such as spray nozzles used in sprayers, planters or the like).

In another example, the agricultural product is recycled from the product circuit and used as the refrigerant for the heat exchanger system 100. A refrigerant recycling line 114 is in communication with the distributor 112 and a refrigerant inlet 204 (shown in FIG. 2). In an example with ammonia as the agricultural product, ammonia is reclaimed from the product circuit and flows through the refrigerant recycling line 114. The reclaimed (e.g., recycled) ammonia enters the heat exchange unit 102 and is used as the refrigerant for the heat exchanger system 100.

In another example, the heat exchanger system 100 includes other features to facilitate the operation of the heat exchanger system 100 including but not limited to valves, interconnecting tubes and piping providing communication between components, one or more pumps and the like. Flow meters provided at one or more of upstream or downstream positions and corresponding control valves control the flow of the agricultural production through the heat exchanger system 100 including the heat exchange unit 102.

Figure 2:
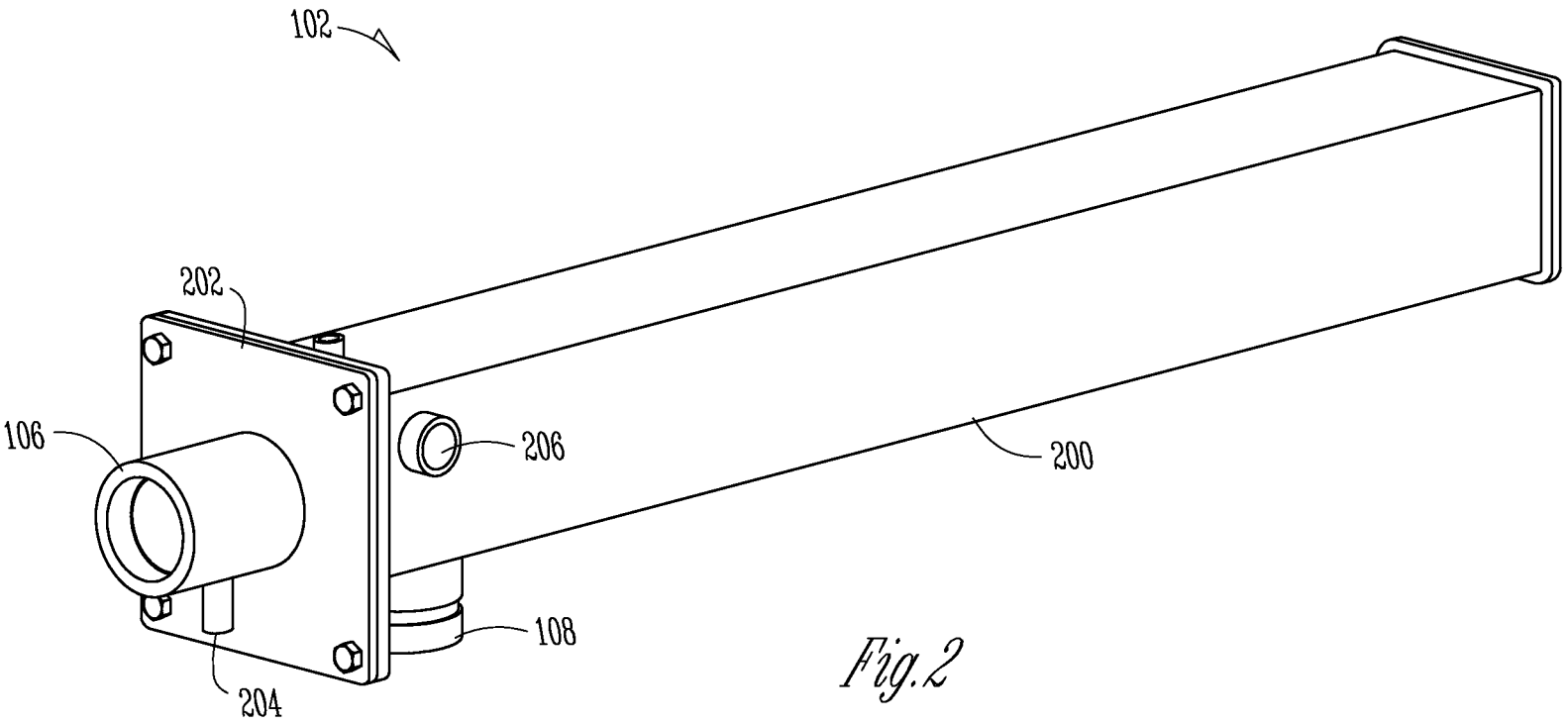
FIG. 2 is a perspective view of one example of a heat exchange unit.

FIG. 2 shows a perspective view of one example of a heat exchange unit 102. In an example, the heat exchange unit 102 includes a unit housing 200 as a component of the heat exchange unit 102 configured to retain the passages and heat transfer features of the unit therein. For instance, as shown in FIG. 2, a housing cap 202 is coupled to the unit housing 200. In one example, the internal components of the heat exchange unit 102 are coupled to the housing cap 202 to facilitate the loading and unloading of the components into the unit housing 200. Stated another way, the coupling of the internal components of the heat exchange unit 102 to the housing cap 202 simplifies the assembly process for the heat exchange unit 102. That is to say, the internal components of the heat exchange unit are assembled externally to the unit housing 200, coupled with the housing cap 202 and then installed within the unit housing 200. The internal components are then placed inside the unit housing 200 and the housing cap 202 is coupled to the unit housing 200. Accordingly, labor intensive assembly of multiple components within the confines of the unit housing 200 is avoided. Coupling of the housing cap 202 to the unit housing 200 secures the internal components within the unit housing 200.

As shown in FIG. 2 a refrigerant inlet 204 is provided with the heat exchange unit 102. The refrigerant inlet 204 is in turn coupled to a supply of refrigerant. The refrigerant includes, but is not limited to R-134a (1,1,1,2-Tetrafluoroethane), R-410a (a mixture of difluoromethane and pentafluoroethane), ammonia that is recycled from the product circuit 316 by way of the refrigerant recycling line 114 or the like. In an example, refrigerant is delivered through the refrigerant inlet 204 and into a refrigerant circuit contained within the unit housing 200 and described in detail herein. As further shown in FIG. 2, at least one refrigerant outlet 206 is provided with the heat exchange unit 102. The refrigerant exits the heat exchange unit though at least one refrigerant outlet 206 after passing through the refrigerant circuit described herein.

As described above, an agricultural product, such as ammonia, is delivered to the product inlet 106 in a vapor form (e.g., a mixture of liquid and gas phases of the agricultural product). The agricultural product flows into the heat exchange unit 102 and flows through a product circuit to cool the agricultural product and in at least one example transition the vapor to a form having more liquid at the product outlet 108 of the heat exchange unit 102. Stated another way, the heat exchange between the flowing agricultural product and the refrigerant within the heat exchange unit 102 decreases the gas content of the vapor and increases the relative liquid content.

The product circuit and the refrigerant circuit are isolated from each other such that the agricultural product flowing through the product circuit and the refrigerant flowing through the refrigerant circuit do not mix. Instead heat exchange occurs between the refrigerant circuit and the product circuit to cool and phase change the agricultural product (e.g., ammonia). In an example, the cooling of the ammonia within the heat exchange unit 102 results in a substantially complete (near complete or complete) phase change of the gas component of ammonia vapor to a liquid phase. In another example, the cooling of the ammonia results in a partial phase change of the ammonia from a gas phase to a mix between a gas and a liquid phase, such that the ammonia is substantially more in a liquid phase than a gaseous phase. This partial or complete phase change results in the ammonia exiting the product outlet 108 substantially as a liquid (e.g., entirely as a liquid or as a vapor with a larger liquid component than at the product inlet 106).

Figure 3:
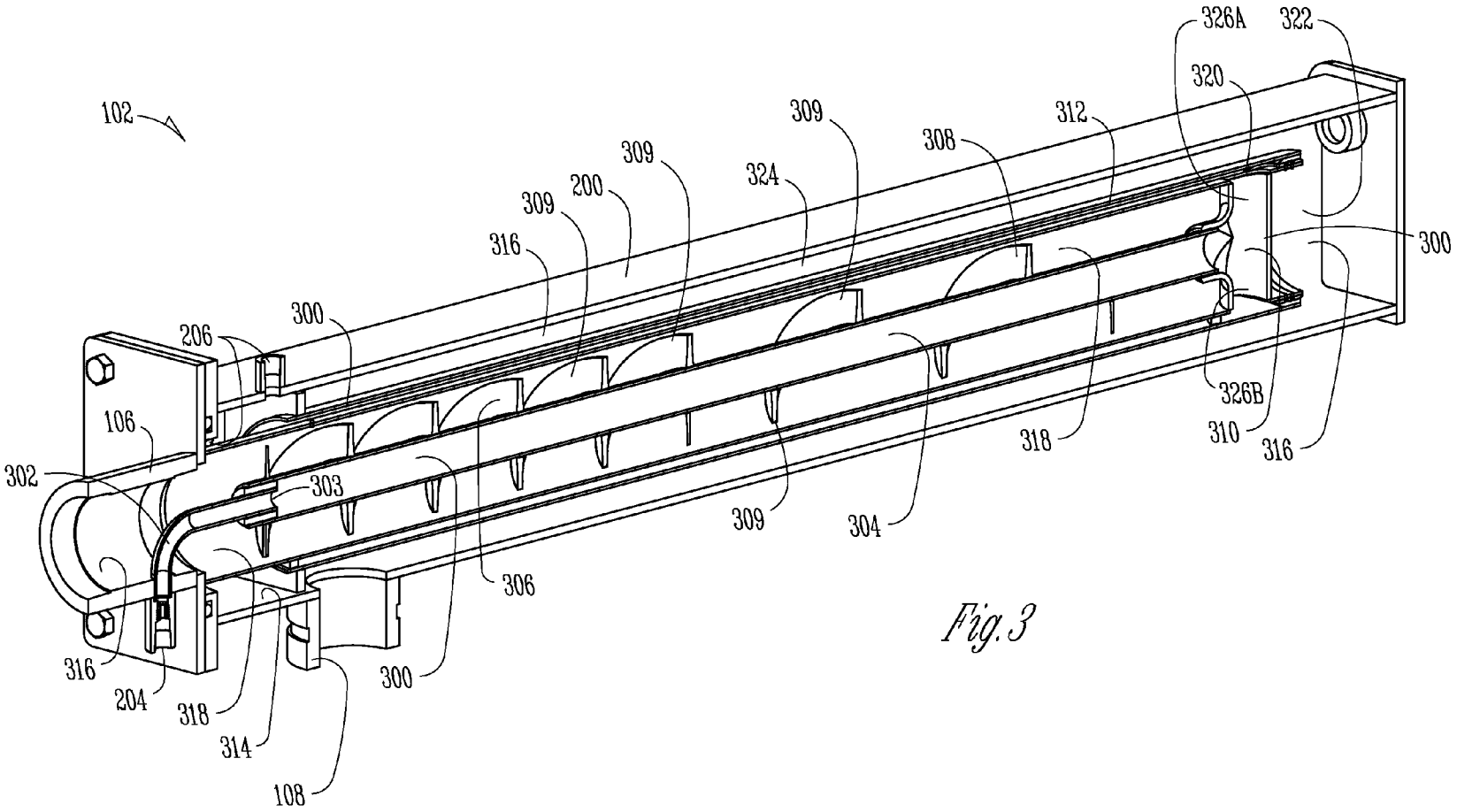
FIG. 3 is a cross sectional view of the heat exchange unit of FIG. 2.

FIG. 3 is a sectional view of the heat exchange unit 102. As described above, refrigerant enters the refrigerant circuit 300 through the refrigerant inlet 204. The refrigerant inlet 204 is in communication with a heat exchange delivery line 302. The heat exchange delivery line 302 is, in turn, in communication with a heat exchange tube inlet 303. The heat exchange tube inlet is, in turn, in communication with a heat exchange tube 304. In an example, the heat exchange tube 304 extends linearly from the heat exchange tube inlet 303 to a refrigerant return 310. A first fin zone 306 and a second fin zone 308 are coupled to the heat exchange tube 304. In an example one or more of the first and second fin zones 306, 308 include one or more heat exchange fins 309. In an example, the heat exchange fins 309 extend from the heat exchange tube 304 to a position adjacent an interior layer of a heat exchange jacket 320. The heat exchange fins 309 disrupt fluid boundary layers along the heat exchange tube and the interior layer of the heat exchange jacket to facilitate enhanced heat exchange. Additionally, the first fin zone 306 and the second fin zone 308 provide a tortuous path for the agricultural product to flow through, resulting in an increased dwell time of the agricultural product within a first product passage 318.

In an example, the first fin zone 306 and the second fin zone 308 wrap around the heat exchange tube 304 in the shape of a helix (e.g., a continuous helical heat exchange fin). In another example, the heat exchange fins 309 consist of one or more geometric shapes (e.g., circle, triangle, square, hexagon, etc.) arranged along the heat exchange tube 304. For instance, the heat exchange fins 309 are individually formed and provided in a staggered arrangement along the heat exchange tube 304. In an example, the space between the heat exchange fins 309 (e.g., pitch or spacing between turns) within the first fin zone 306 is less than the space between the heat exchange fins 309 within a second fin zone 308. In another example, the space between the heat exchange fins 309 within the first fin zone 306 is greater than the space between the heat exchange fins 309 within the second fin zone 308. In yet another example, the space between the heat exchange fins 309 within the first fin zone 306 is equal to the space between the heat exchange fins 309 within the second fin zone 308. Optionally, the heat exchange fins are double flighted (e.g., with two fin assemblies nested within one another). The double fighting of the fin assemblies is beneficial with low flow rates (velocity) of agricultural product. The double flighted heat exchange fins 309 enhance turbulation of the agricultural product and accordingly envelope the refrigerant circuit more quickly than with single flighting.

The heat exchange tube 304 is also in communication with at least one refrigerant return 310. As shown in FIG. 3, the refrigerant return 310 is a bifurcated passage that redirects the flow of the refrigerant for further cooling of the agricultural product. In another example, the refrigerant return 310 includes, but is not limited to, one or more passages 326A, B that redirect the flow of the refrigerant. In the example shown in FIG. 3, the refrigerant return 310 includes two passages. In other examples, the refrigerant return 310 includes one, two, three passages or the like. The refrigerant return 310 is in communication with a jacket passage 312. In the example shown in FIG. 3, the jacket passage 312 is a cavity within the heat exchange jacket 320 between the first product passage 318 and a second product passage 324 (the first and second product passages 318, 324 deliver the agricultural product along the refrigerant circuit 300 and are described further herein).

In operation, refrigerant within the heat exchange tube 304 is redirected by the refrigerant return 310 through the heat exchange jacket 320 toward the refrigerant outlet 206. Stated another way, the refrigerant passes through the refrigerant return 310 and moves through the jacket passage 312 in a direction opposite to the direction that the refrigerant moved through the heat exchange tube 304. Because the refrigerant return 310 is provided with multiple passages the refrigerant is distributed around the heat exchange jacket 320 to multiple portions of the jacket passage 312. In another example, a single return passage is provided and the refrigerant flows through the jacket passage 312 and around the heat exchange jacket 320.

As shown in FIG. 3, in an example, the jacket passage 312 is in communication with an optional refrigerant collection reservoir 314 and a refrigerant outlet 206 provided near the refrigerant collection reservoir 314. The refrigerant collection reservoir 314 communicates with the refrigerant outlet 206. In another example, the refrigerant collection reservoir 314 is a cavity formed between the first product passage 318 and the unit housing 200. As with the other components of the refrigerant circuit 300 the refrigerant collection reservoir 314 is isolated from the product circuit 316. After flowing through the jacket passage 312 of the heat exchange jacket 320 the refrigerant exits the jacket passage 312 and pools in the refrigerant collection reservoir 314. The refrigerant located within the refrigerant collection reservoir 314 continues to transfer heat from the product in the first product passage 318 (e.g., from the flow of agricultural product as it enters the heat exchange unit 102). The refrigerant is discharged from the refrigerant collection reservoir 314 through the refrigerant outlet 206, for instance with a refrigerant pump. In another example with ammonia as the refrigerant, the ammonia flows out of the refrigerant outlet 206 and is reintroduced back into the product circuit 316 and applied in the same manner as the agricultural product (ammonia) cooled within the product circuit 316.

In an example with ammonia as the agricultural product, the ammonia enters the product inlet 106 and flows into the product circuit 316. The product inlet 106 is in communication with the first product passage 318. Ammonia flows through the product inlet 106 and flows around the heat exchange delivery line 302. The heat exchange delivery line 302 is the first location where heat transfer between the refrigerant circuit 300 and the product circuit 316 occurs (optionally heat transfer also occurs between the refrigerant within the refrigerant collection reservoir 314 and the product in the first product passage 318). Ammonia flows out of the product inlet 106 and into the first product passage 318 and flows around the heat exchange tube 304 and the first fin zone 306. The flow of the ammonia over the heat exchange tube 304 and the first fin zone 306 transfers heat from the ammonia, resulting in a reduction in the temperature of the ammonia. The passage of the ammonia through the first fin zone 306 creates turbulence within the ammonia flow and increases the heat transfer rate from the ammonia to the refrigerant flowing within the refrigerant circuit 300.

In an example, ammonia exits the first fin zone 306 and enters the second fin zone 308. Heat transfer from the ammonia to the refrigerant continues and the temperature of the ammonia is further reduced. Ammonia exits the second fin zone 308 and passes around the refrigerant return 310 (transferring heat from the ammonia to the refrigerant as it does so) and exits the first product passage 318. The first product passage 318 is in communication with a product return 322. The product return 322 is a cavity in between the end of the first product passage 318 and the unit housing 200 and communicates with a second product passage 324. The second product passage 324 is a cavity between the heat exchange jacket 320 and the unit housing 200. The product return 322 redirects the ammonia into the second product passage 324 and the ammonia flows back toward the product outlet 108. Stated another way, the ammonia passes through the product return 322 and moves through the second product passage 324 in a direction opposite to the direction that the ammonia moved through the first product passage 318.

In an example, ammonia flows through the second product passage 324 and passes along the refrigerant circuit 300 for a second time. As the ammonia flows through the second product passage 324, additional heat is transferred from the ammonia flowing through the second product passage 324 into the refrigerant flowing through the jacket passage 312. The second product passage 324 is in communication with the product outlet 108. Ammonia exits the second product passage 324 and enters the product outlet 108.

As discussed herein, the jacket passage 312 refrigerates and further cools the agricultural product (e.g., ammonia) in the second product passage 324. The jacket passage 312 also isolates the flow of agricultural product in the second product passage 324 from the warmer product in the first product passage 318. In other words, heat transfer between the product (e.g., from the warmer product in the first product passage 318 to the cooler product in the second product passage 324) is substantially avoided to accordingly ensure the exiting agricultural product is cooled (and phase changed) as desired. The jacket passage 312 of the refrigerant circuit 300 also cools agricultural product in both of the first and second product passages 318, 324. Accordingly, each exposed surface of the heat exchange jacket 320 (housing the jacket passage 312) is not isolated from the product and instead provides heat transfer to the product at all stages of delivery through the unit 102. Stated another way, the refrigerant within the jacket passage 312 ensures heat transfer from the product in each of the passages and at the same time prevents heat transfer from the product in the first product passage 318 to the second product passage 324. That is to say, the heat exchange jacket 320 having the jacket passage 312 insulates the cooler ammonia flowing through the second product passage 324 from the warmer ammonia flowing through the first product passage 318.

In an example, the flow of ammonia through the product circuit 316 results in a substantially complete (near complete or complete) phase change of the gas component of ammonia vapor to a liquid phase. In another example, the cooling of the ammonia as it flows through the product circuit 316 results in a partial phase change of the ammonia from a gas phase to a mix between a gas and a liquid phase, such that the ammonia is substantially more in a liquid phase than a gaseous phase than at introduction of the heat exchange unit 102. This partial or complete phase change results in the ammonia exiting the product outlet 108 substantially as a liquid (e.g., entirely as a liquid or as a vapor with a larger liquid component than at the product inlet 106). Stated another way, the flow of ammonia through the product circuit 316 results in cooling a first ammonia vapor and liquid mixture (e.g., a vapor and liquid mixture) to a second ammonia vapor and liquid mixture (gas and liquid mixture or liquid) with a relatively larger amount of liquid ammonia relative to the first ammonia vapor. Optionally, the cooled ammonia is delivered through pump 110 and further compressed to correspondingly transition the remaining vapor to a liquid state prior to delivery to one or more applicators.

Figure 4A:
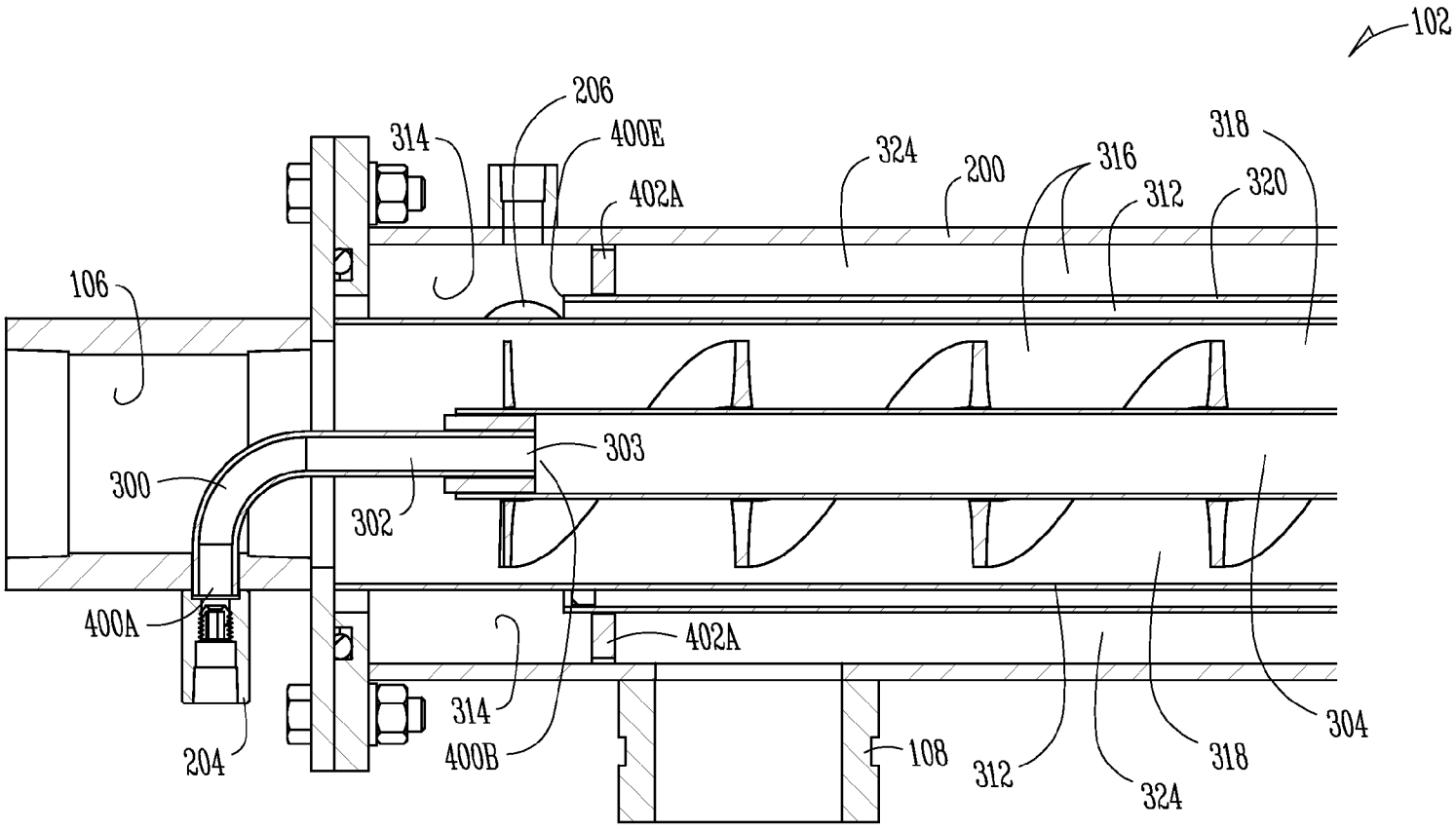
FIG. 4A is a detailed cross sectional view of a portion of the heat exchange unit of FIG. 3.

FIG. 4A is a sectional view of a portion of the heat exchange unit 102. As described herein, refrigerant passes through the refrigerant inlet 204, passes through the heat exchange tube inlet 303, and flows into the heat exchange tube 304. As discussed herein, the refrigerant passes through one or more expansion zones (e.g., 400A-E) to facilitate cooling of the refrigerant as heat transfer occurs between the agricultural product and the refrigerant. As shown in FIG. 4A, a refrigerant expansion zone 400A is located in the heat exchange delivery line 302. As the refrigerant enters the refrigerant expansion zone 400A, the pressure of the refrigerant is reduced, volume expands, and correspondingly a reduction of the refrigerant temperature is realized. In another example, the refrigerant circuit 300 includes at least another expansion zone 400B. As shown in FIG. 4A, the expansion zone 400B is at the interface between the heat exchange delivery line 302 and the heat exchange tube inlet 303. The pressure and volume of the refrigerant are respectively decreased and increased as the refrigerant enters the heat exchange tube inlet 303, resulting in a further reduction of the temperature of the refrigerant. As described further herein, additional expansion zones, such as 400C, D, E are provided to facilitate additional decreases in temperature and ensure continue cooling of the agricultural product.

As further shown in FIG. 4A, a circuit partition 402A is provided between the second product passage 324 and the refrigerant collection reservoir 314. In one example, the circuit partition 402A is a wall interposed between the passage 324 and the unit housing 200 and sealed between each (e.g., welded, adhered or the like). In an example, the circuit partition 402A is formed by inserting the heat exchange jacket 320 into the unit housing 200. The heat exchange jacket is then coupled (e.g., welded, adhered or the like) to the unit housing 200. The circuit partition 402A ensures the refrigerant circuit 300 remains separated from the product circuit 316.

Figure 4B:
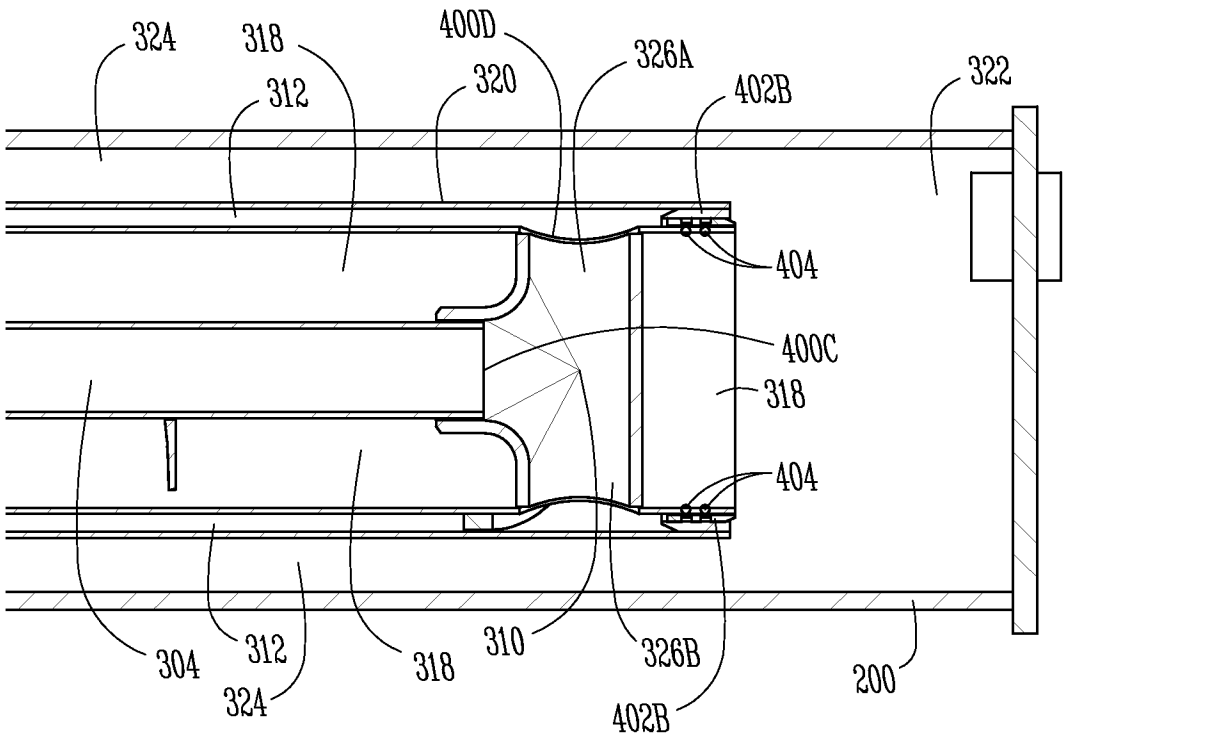
FIG. 4B is a detailed cross sectional view of another portion of the heat exchange unit of FIG. 3.

FIG. 4B is a sectional view of another portion of the heat exchange unit 102. As described herein, refrigerant flows through the heat exchange tube 304 and enters the refrigerant return 310. In another example, as shown in FIG. 4B, a refrigerant expansion zone 400C is located at the interface between the heat exchange tube 304 and the refrigerant return 310. As the refrigerant enters the refrigerant expansion zone 400C, the pressure of the refrigerant is reduced, volume is increased, and correspondingly the refrigerant temperature is reduced. As discussed herein, in one example, the refrigerant return includes one or more passages to distribute the flow of refrigerant to the jacket passage 312. Optionally, the one or more passages are chosen according to the desired expansion characteristics (e.g., corresponding cooling) desired for the heat exchange unit 102. In still yet another example, a refrigerant expansion zone 400D is located at the interface between the refrigerant return 310 and the heat exchange jacket 320. As the refrigerant enters the refrigerant expansion zone 400D, the pressure of the refrigerant is reduced, volume is increased, and correspondingly the refrigerant temperature is reduced.

As further shown in FIG. 4B, a circuit partition 402B is provided within the heat exchange jacket 320 and is located near the interface of the first product passage 318 and the product return 322. As discussed herein, in an example, at least a portion of the heat exchange jacket 320 (such as an outer shell) is coupled to the unit housing 200. In one example, the circuit partition 402B is formed by inserting a sub-assembly into the heat exchange jacket 320. In an example, the sub-assembly includes, but is not limited to, the portions of the heat exchange unit including the first product passage 318, the heat exchange tube 304, the first fin zone 306, the second fin zone 308 and the like (see FIG. 3). Sealing features 404, such as O-rings, gaskets, sealants or the like are coupled to the exterior of the sub-assembly (or alternatively to the interior of the portion of the heat exchange jacket 320 associated with the unit housing 200). The sub-assembly is slid into the heat exchange jacket 320 and the sealing features 404 provide an interference fit between the outer portion of the heat exchange jacket 320 and the inner portion of the jacket 320 (forming the outer perimeter of the first product passage 318), thereby forming the circuit partition 402B. The circuit partition 402B ensures the refrigerant circuit 300 remains separated from the product circuit 316.

Referring again to FIG. 4A, the expansion zone 400E is located at the interface between the jacket passage 312 and the refrigerant collection reservoir 314. In yet another example, the pressure of the refrigerant is reduced, and the volume expands, as the refrigerant exits the jacket passage 312 and enters the refrigerant collection reservoir 314. The refrigerant accordingly reduces its temperature and provides another zone for heat transfer from the product to the refrigerant (e.g., at the product outlet orifice 206).

Figure 5:
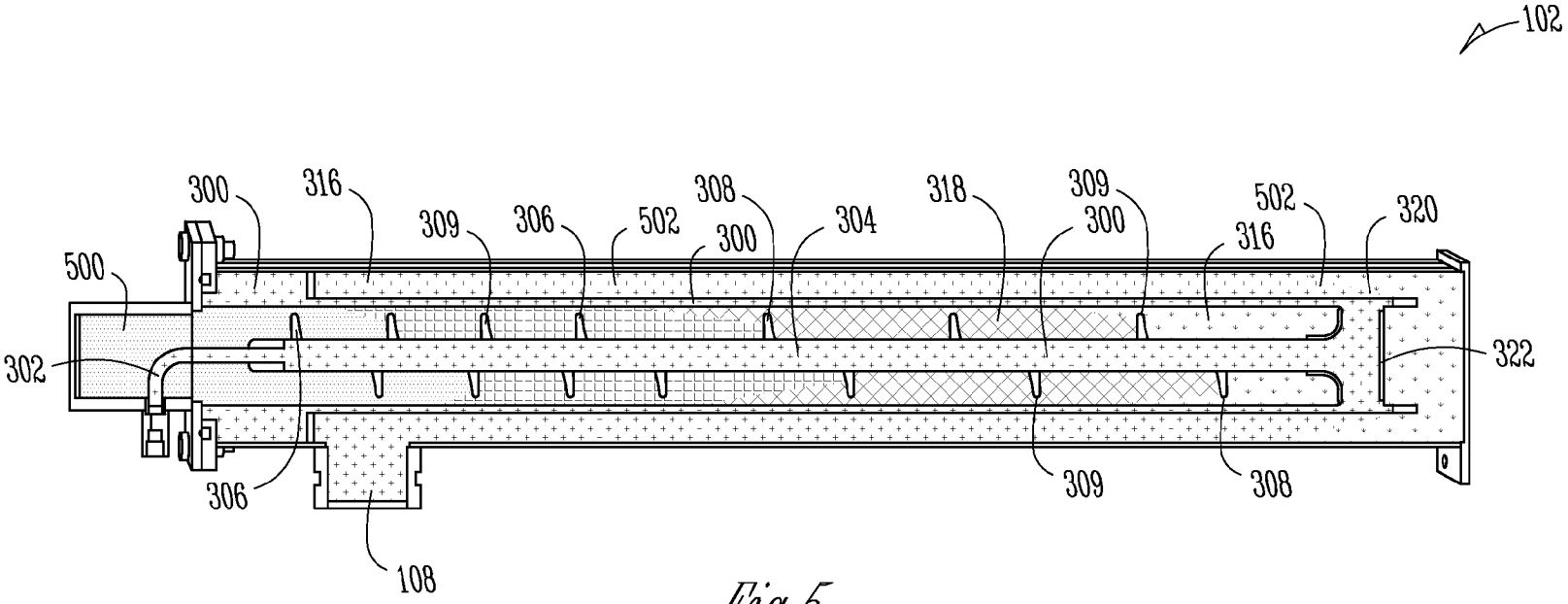
FIG. 5 is a flow diagram showing one example of cooling of the agricultural product.

FIG. 5 is an exemplary view of results of a finite element analysis of the heat exchange unit 102. As shown in FIG. 5 and discussed herein, an agricultural product enters the heat exchange unit 102 at a relatively high temperature (e.g., 40 degrees Fahrenheit). Refrigerant enters the heat exchange unit 102 at a relatively low temperature (e.g., lower than 30 degrees Fahrenheit). As the agricultural product flows past the heat exchange delivery line 302 and into a first heat exchange zone 500 it starts to cool as shown with the exemplary stippling.

The agricultural product continues to flow through the first heat exchange zone 500 and enters the first fin zone 306 along the heat exchange tube 304. The first fin zone 306 induces turbulence within the flow of the agricultural product (that is flowing through the first product passage 318) and provides increased surface area for conductive and convective heat transfer to occur between the refrigerant circuit 300 and the product circuit 316. The disruption of boundary conditions (e.g., boundary layers along the interior layer of the heat exchange jacket 320 and the heat exchange tube 304) caused by the plurality of fins providing in the one or more fin zones introduces turbulence within the flow of the agricultural product. Further, the plurality of fins increase the heat transfer surface area of the heat exchange tube 304 and correspondingly enhance the heat transfer rate from the agricultural product to the refrigerant. The agricultural product exits the first fin zone 306 at a lower temperature (e.g., 37 degrees Fahrenheit) relative to the temperature of the agricultural product upon entry to the heat exchange unit 102.

The agricultural product enters the optional second fin zone 308 from the first fin zone 306 and experiences continued disruption of boundary conditions and turbulence. Stated another way, the first fin zone 306 and the second fin zone 308 turbulate the agricultural product. Turbulation, in one example, spins the agricultural product within the first product passage 318 according to the helical configuration of the heat exchange fins 309. The second fin zone 308 provides increased surface area (relative to the heat exchange tube 304 alone). Accordingly, the agricultural product exits the second fin zone 308 at a lower temperature relative to a temperature in the first fin zone 306 (e.g., 32 degrees Fahrenheit).

The agricultural product is redirected by the product return 322 toward the product outlet 108 and passes over the heat exchange jacket 320. At this point, the agricultural product enters a second heat exchange zone 502. Heat from the agricultural product is transferred to the refrigerant as the agricultural product flows over the heat exchange jacket 320. The agricultural product flows into the product outlet 108 at a still lower temperature (e.g., 28.5 degrees Fahrenheit). The phased cooling of the agricultural product is shown with the stippling provided in FIG. 5. The agricultural product is cooled and accordingly changes phases in a series of heat exchange zones (e.g., the first and second heat exchange zones, as described herein) within the heat exchange unit 102.

FIG. 6A is a schematic diagram of a vehicle train 601 including an agricultural product application system. In one example, the vehicle train 601 includes a prime mover 600A (e.g., tractor, combine or the like), an applicator 602A, and a product tender 604A. In an example, the heat exchanger system 100 is a component of the applicator 602A. The pump 110 (as shown in FIG. 1) provides a pressurized flow of the agricultural product through the distributor 112 to nozzles of the applicator 602A. The heat exchanger system 100 is optionally coupled to the applicator 602A (e.g., by a bracket, mount, fasteners, or the like). In an example, the product tender 604A is physically coupled (e.g., by a ball hitch, pintle hitch or the like) to the applicator 602A such that they move together as a unit. As described herein, the product tender 604A is in communication with the manifold 106 (see FIG. 1) of the heat exchanger system 100. In an example, the applicator 602A is in turn physically coupled to the prime mover 600A (e.g., by a ball hitch, pintle hitch or the like). In an example, the refrigerant inlet 204 and refrigerant outlet 206 are in communication with a prime mover refrigerant circuit that provides a flow of refrigerant to the heat exchange unit 102 as described herein. Alternatively, the applicator 602A includes a dedicated refrigerant system (e.g., pump, compressor, heat exchange coils, expansion valves and the like) configured to provide a flow of chilled refrigerant to the unit 102.

In operation, the prime mover 600A is capable of moving the applicator 602A and product tender 604A in a manner as desired by the operator. In an example, the product tender 604A stores agricultural product for delivery to the heat exchanger system 100 and application by the applicator 602A. Agricultural product flows out of the product tender 604A and into the heat exchanger system 100 (see FIG. 1). Simultaneously, refrigerant flows between the refrigerant circuit (conditioned on the prime mover 600A) and to the heat exchanger system 100. The agricultural product is cooled as it passes through the heat exchanger system 100, as described herein. The agricultural product exits the heat exchanger system 100 and flows through at least one applicator feature, such as one or more nozzles. The one or more nozzles apply the (cooled) agricultural product in a manner as desired by the operator (e.g., at a desired flow rate, pressure and the like).

Optionally, as discussed herein, the refrigerant circuit is an open loop circuit wherein the agricultural product (e.g., ammonia) is reclaimed from the product circuit 316 and is used as the refrigerant for the refrigerant circuit 316. The agricultural product is reclaimed from the product circuit 316 (e.g., with the refrigerant recycling line 114 shown in FIG. 1) and flows into the refrigerant inlet 204. After the ammonia flows through the refrigerant circuit 300, the ammonia exits the heat exchange unit 102. The ammonia flows out of the refrigerant outlet 206 and is reintroduced back into the product circuit 316. The ammonia then flows to the applicator 602A and is applied. This reclamation of ammonia as a refrigerant results provides for efficient use of the ammonia. Stated another way, ammonia is not wasted during the process (e.g., any product that is removed from the product circuit 316 is reintroduced to the product circuit 316 at a later point in time).

Figure 6B:
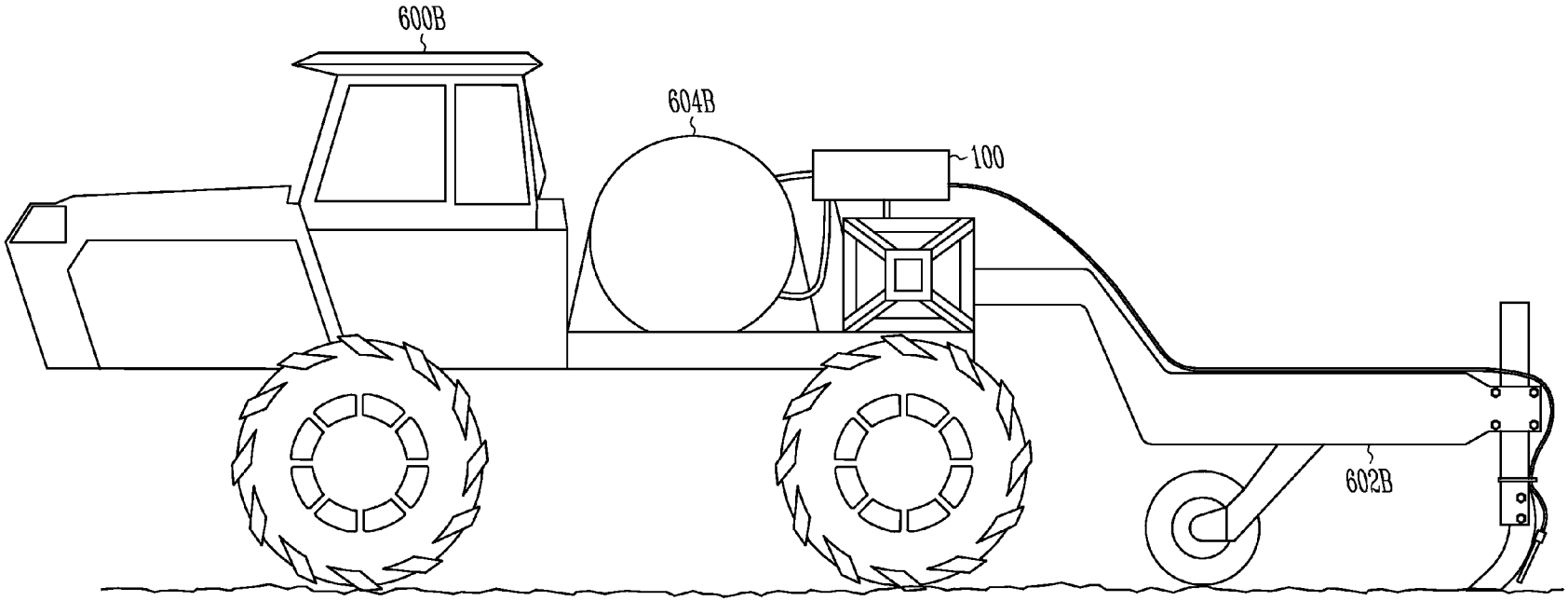
FIG. 6B is a schematic of one example of an applicator and a product tender mounted to a tall prime mover.

FIG. 6B is a schematic diagram of a prime mover 600B (e.g., dedicated sprayer vehicle or the like) with an agricultural product application system having one or more applicators 602B and an agricultural product reservoir 604B. In an example, applicators 602B are coupled to the prime mover 600B (e.g., by a bracket, mount, fasteners, or the like). In an example, the heat exchanger system 100 is coupled between the agricultural product reservoir 604B and the one or more applicators 604B. For instance, the heat exchanger system 100 is coupled to a portion of the prime mover (e.g., by a bracket, mount, fasteners, or the like). In an example, the refrigerant inlet 204 and refrigerant outlet 206 are in communication with a refrigerant circuit incorporated with the prime mover 600B that provides a flow of refrigerant to the heat exchange unit 102 as described herein. Alternatively, the prime mover 600B includes a dedicated refrigerant system (e.g., pump, compressor, heat exchange coils, expansion valves and the like) configured to provide a flow of chilled refrigerant to the heat exchanger system 100 including the heat exchange unit 102.

In either example (with the prime mover 600B or an implement train including prime mover 600A), the pump 110 of the heat exchanger system 100 is in communication with a distributor 112, and the distributor is in communication with the one or more applicators 602A, B. The applicator feature of the applicators 602A, B, such as a nozzle, directs the agricultural product toward the ground to deposit the agricultural product with a minimal amount of loss of the agricultural product to the nearby surroundings.

Figure 7:
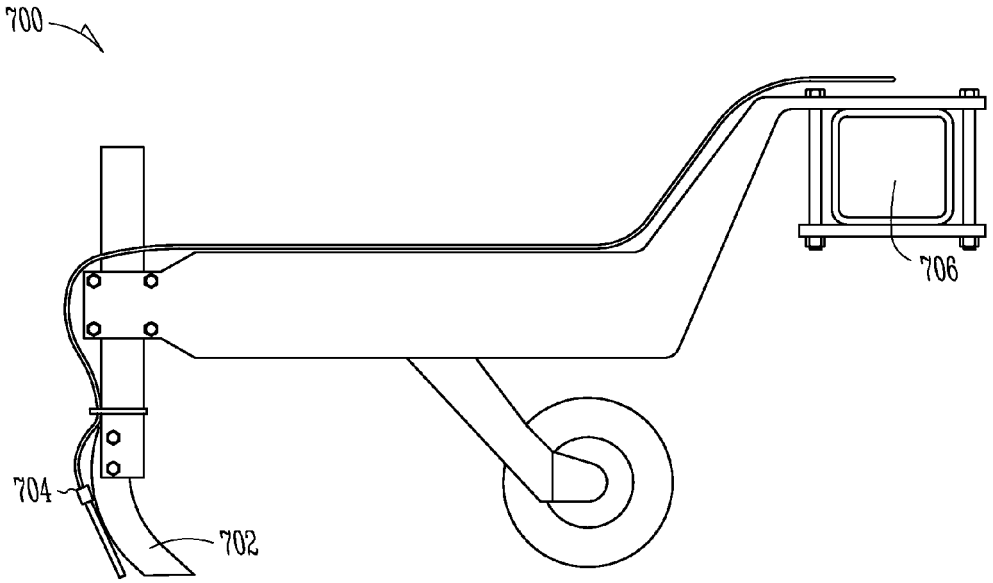
FIG. 7 is a perspective view of one example of a product applicator.

FIG. 7 is a schematic view of an exemplary applicator 700, for instance as part of a planter. As shown the applicator 700 includes at least one cutting tool 702 and an applicator feature 704. In an example, one or more applicators 700 are coupled along an arm 706 extending from near a midpoint of the planter. The planter is hitched to a prime mover, such as the prime mover 600A shown in FIG. 6A. As shown in FIG. 7, the arm 706 extends into and out of the page and accordingly, in another example, a plurality of applicators are coupled along the arm 706.

In operation, a prime mover (600A, B) moves through a field with an applicator such as the applicator 700 (or the boom mounted applicator 602B). In the example with the applicator 700, the cutting tool 702 (e.g., knife, coulter or the like) located on the applicator 700 cuts the soil to a specified depth. The applicator feature 704 (e.g., nozzle, sprayer or the like) applies the agricultural product into the furrow formed with the cutting tool. As described herein the agricultural product is provided in a liquid form (e.g., fully liquid or substantially liquid with some vapor) according to the operation of the heat exchanger system 100.

Figure 8:
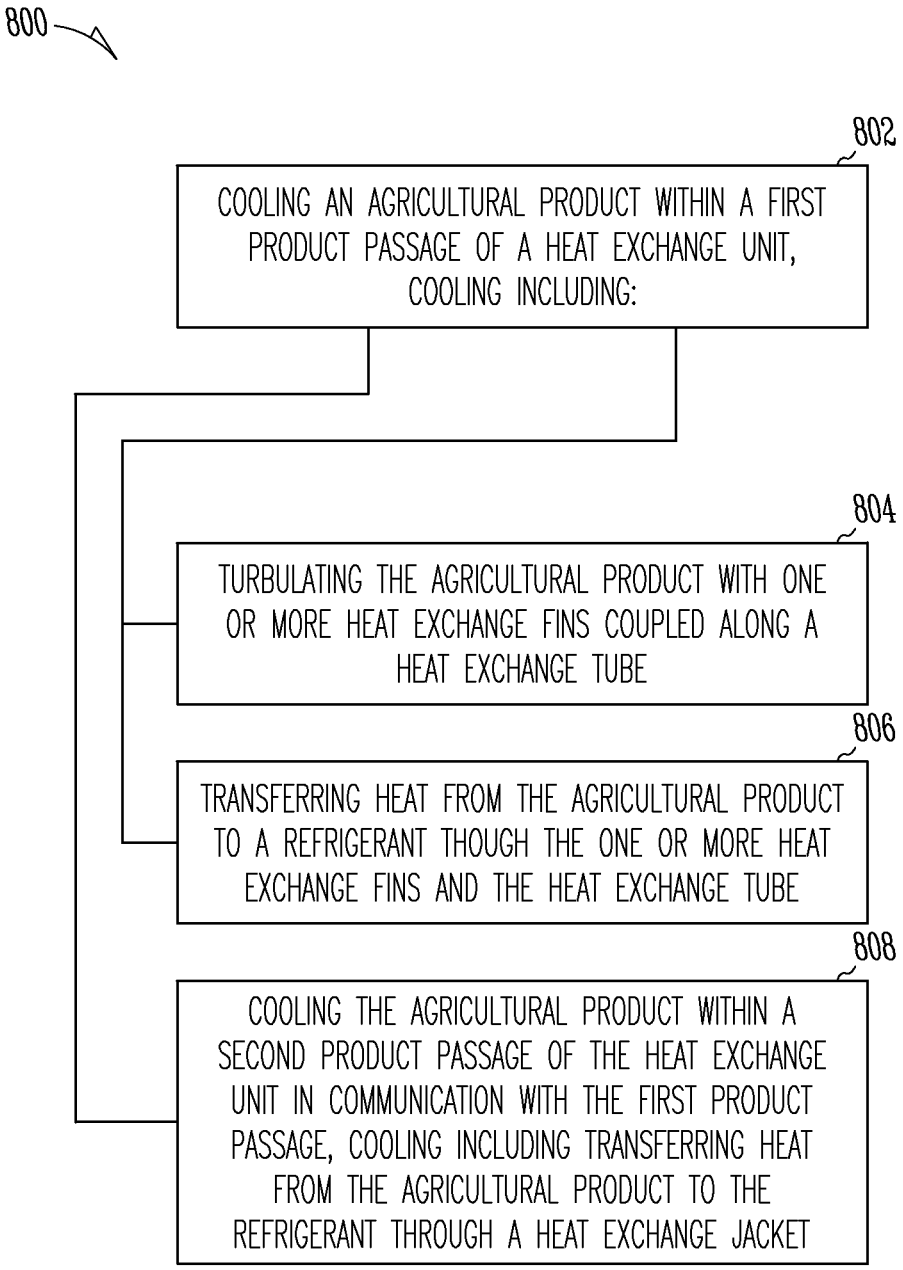
FIG. 8 is a block diagram of a method for cooling an agricultural product.

FIG. 8 shows one example of a method 800 for cooling an agricultural product. In describing the method 800 reference is made to one or more components, features, functions and steps previously described herein. Where convenient, reference is made to the components, features, steps and the like with reference numerals. Reference numerals provided are exemplary and are not exclusive. For instance, components, features, functions, steps and the like described in the method 800 include, but are not limited to, the corresponding numbered elements provided herein, other corresponding features described herein (both numbered and unnumbered) as well as their equivalents.

At 802 the method 800 includes cooling an agricultural product within the first product passage 318 of a heat exchange unit 102. The first product passage 318 is a part of the product circuit 316 extending from the product inlet 106 to the product return 322. In an example with ammonia as the agricultural product, ammonia flows out of the product inlet 106 and into the first product passage 318 and flows along and around the heat exchange tube 304 and a plurality of fins, for instance first and second fin zones 306, 308. In an example, the flow of ammonia through the product circuit 316 results in a substantially complete (near complete or complete) phase change of the gas component of ammonia vapor to a liquid phase. In another example, cooling of the ammonia as it flows through the product circuit 316 results in a partial phase change of ammonia gas (e.g., as part of a vapor or vapor and liquid mixture) from a gas phase to a mix between a gas and a liquid phase. Accordingly, the ammonia exits the heat exchange unit 102 in a substantially greater liquid phase than a gaseous phase at introduction of the ammonia to the heat exchange unit 102. This partial or complete phase change results in the ammonia exiting the product outlet 108 substantially as a liquid (e.g., entirely as a liquid or as a vapor with a larger liquid component than at the product inlet 106).

Cooling of the agricultural product includes at 804, turbulating the agricultural product with one or more heat exchange fins 309 coupled along a heat exchange tube 304. As discussed herein, an example first fin zone 306 induces turbulence within the flow of the agricultural product (that is flowing through the first product passage 318) and provides increased surface area for conductive and convective heat transfer to occur between the refrigerant circuit 300 and the product circuit 316. The disruption of boundary conditions (e.g., boundary layers along the interior layer of the heat exchange jacket 320 and the heat exchange tube 304) caused by the plurality of fins providing in the one or more fin zones introduces turbulence within the flow of the agricultural product. The agricultural product enters the optional second fin zone 308 from the first fin zone 306 and experiences continued disruption of boundary conditions and turbulence.

In another example, cooling of the agricultural product includes at 806 transferring heat from the agricultural product to a refrigerant though the one or more heat exchange fins and the heat exchange tube. As discussed herein, the flow of the agricultural product, in this case ammonia, over the heat exchange tube 304 and an exemplary first fin zone 306 (of one or more fin zones) transfers heat from the ammonia, resulting in a reduction in the temperature of the ammonia and a phase change of the gaseous component of the ammonia (e.g, of an ammonia vapor). The ammonia exits the first fin zone 306 and enters the optional second fin zone 308. Heat transfer from the ammonia to the refrigerant continues and the temperature of the ammonia is further reduced and the phase change continues. In yet another example, cooling the agricultural product within the first product passage 318 includes transferring heat from the agricultural product to the refrigerant through the heat exchange jacket 320. In still yet another example, cooling the agricultural product within the first product passage 318 includes increasing the dwell time within the first product passage with a tortuous path provided by the one or more heat exchange fins 309. Optionally, the plurality of fins increase the heat transfer surface area of the heat exchange tube 304 and correspondingly enhances the heat transfer rate from the agricultural product to the refrigerant.

At 808, the method 800 includes cooling the agricultural product within a second product passage 324 of the heat exchange unit in communication with the first product passage 318, cooling including transferring heat from the agricultural product to the refrigerant through a heat exchange jacket 320. The first product passage 318 is in communication with a product return 322. In one example, the product return 322 is a cavity in between the end of the first product passage 318 and the unit housing 200 and communicates with the second product passage 324. In an example, ammonia flows through the second product passage 324 and continues along the refrigerant circuit 300 for cooling (and phase changing) a second time. As the ammonia flows through the second product passage 324, additional heat is transferred from the ammonia flowing through the second product passage 324 into the refrigerant flowing through the jacket passage 312.

Several options for the method 800 follow. In one example, turbulating the agricultural product includes disrupting fluid boundary layers along the heat exchange tube with the one or more heat exchange fins 309. In another example, turbulating the agricultural product includes disrupting fluid boundary layers along an interior layer of the heat exchange jacket 320 with the one or more heat exchange fins 309. Optionally, turbulating the agricultural product includes spinning the agricultural product within the first product passage according to a helical configuration of the one or more heat exchange fins 309. In still another example, turbulating the agricultural product includes turbulating the agricultural product in a first fin zone 306 near a product inlet of the heat exchange unit and a second fin zone 308 near a product return of the heat exchange unit. The second fin zone 308 includes a second spacing between turns of the one or more heat exchange fins 309 greater than a first spacing between turns of the one or more heat exchange fins in the first fin zone 306.

In one example, cooling the refrigerant within the heat exchange unit 102 includes expanding the refrigerant through one or more refrigerant expansion zones, such as expansion zones 400A-E in the refrigerant circuit 300 extending through the heat exchange tube 304, a refrigerant return 310 in communication with the heat exchange tube 304, and the heat exchange jacket 320 in communication with the refrigerant return 310. In an example, expanding the refrigerant includes the refrigerant entering a first refrigerant expansion zone 400A in a heat exchange delivery line 302 in communication with the heat exchange tube 304. In another example, the refrigerant enters a second refrigerant expansion zone 400B at an interface of the heat exchange delivery line 302 and the heat exchange tube 304. In yet another example, the refrigerant enters a third refrigerant expansion zone 400C at an interface between the heat exchange tube 304 and the refrigerant return 310. In still yet another example, the refrigerant enters a fourth refrigerant expansion zone 400D at an interface between the refrigerant return 310 and the heat exchange jacket 320. Optionally, the refrigerant enters a fifth refrigerant expansion zone 400E at an interface between the heat exchange jacket 320 and a refrigerant collection reservoir 314. Another option for the method 800 includes the refrigerant entering an expansion zone including two or more passages 326A, B of the refrigerant return 310. The two or more passages 326A, B extend from the heat exchange tube 304 to the heat exchange jacket 320 and allow for expansion of the refrigerant (and distribution of the refrigerant to the heat exchange jacket 320) according to number of passages. In the example shown in FIG. 4B, two passages 326A, B are provided for the refrigerant return 310. Optionally, the refrigerant return 310 includes one or more passages 326A, B (e.g., one, two, three, four or the like).

Another option for the method 800 includes delivering the refrigerant through the heat exchange unit 102 including delivering refrigerant through the heat exchange tube 304 to the heat exchange jacket 320 through the refrigerant return 310. In an example, the method 800 includes delivering the agricultural product through the first and second product passages 318, 324 in the same directions as flow of the refrigerant through the heat exchange tube 304 to the heat exchange jacket 320 through the refrigerant return 310. Stated another way, the agricultural product and the refrigerant flow in the same direction through each of the passes through the heat exchange unit 102. Optionally, cooling the agricultural product within the first and second product passages 318, 324 includes decreasing a gas content and increasing a liquid content of the agricultural product. In another example, the method 800 includes compressing the agricultural product with a pump 110 to further decrease the vapor content and increase the liquid content of the agricultural product.

Yet another option for the method 800 includes applying the agricultural product after cooling (and changing the phase of at least a portion of the agricultural product). In an example, applying the agricultural product includes cutting soil with a plurality of soil cutting tools of an applicator. In another example, applying the agricultural product includes dispensing the agricultural product within respective soil cuts made from cutting.

VARIOUS NOTES & EXAMPLES

Example 1 can include subject matter, such as can include a heat exchange unit comprising: a unit housing having a product inlet, a product outlet, and a product return; a heat exchange tube within the unit housing, the heat exchange tube including: a heat exchange tube inlet, and one or more heat exchange fins coupled along the heat exchange tube; a refrigerant return, the heat exchange tube extending from the heat exchange tube inlet to the refrigerant return; a heat exchange jacket interposed between the heat exchange tube and the unit housing, the heat exchange jacket including a jacket passage in communication with the refrigerant return; wherein a first product passage extends from the product inlet to the product return, and the heat exchange tube extends along the first product passage; and wherein a second product passage extends from the product return to the product outlet, and the jacket passage extends along the second product passage.

Example 2 can include, or can optionally be combined with the subject matter of Example 1, to optionally include wherein the heat exchange tube extends linearly from the heat exchange tube inlet to the refrigerant return.

Example 3 can include, or can optionally be combined with the subject matter of one or any combination of Examples 1 or 2 to optionally include wherein the one or more heat exchange fins includes a continuous helical heat exchange fin extending between the heat exchange tube inlet and the refrigerant return.

Example 4 can include, or can optionally be combined with the subject matter of one or any combination of Examples 1-3 to optionally include wherein the one or more heat exchange fins includes a first fin zone near the product inlet and a second fin zone near the product return, the first fin zone having a first spacing between turns of the one or more heat exchange fins, and the second fin zone having a second spacing between turns of the one or more heat exchange fins greater than the first spacing.

Example 5 can include, or can optionally be combined with the subject matter of one or any combination of Examples 1-4 to optionally include wherein the one or more heat exchange fins extend from the heat exchange tube to a position adjacent an interior layer of the heat exchange jacket, and the one or more heat exchange fins are configured to disrupt fluid boundary layers along the heat exchange tube and the interior layer of the heat exchange jacket.

Example 6 can include, or can optionally be combined with the subject matter of Examples 1-5 to optionally include a refrigerant circuit including the heat exchange tube and the heat exchange jacket, and one or more refrigerant expansion zones are provided along the refrigerant circuit.

Example 7 can include, or can optionally be combined with the subject matter of Examples 1-6 to optionally include wherein the refrigerant circuit includes a heat exchange delivery line coupled with the heat exchange tube inlet, and the one or more refrigerant expansion zones includes a plurality of refrigerant expansion zones, the plurality of refrigerant expansion zones includes: a refrigerant expansion zone in the heat exchange delivery line, a refrigerant expansion zone at an interface of the heat exchange delivery line and the heat exchange tube inlet, a refrigerant expansion zone at an interface between the heat exchange tube and the refrigerant return, a refrigerant expansion zone at an interface between the refrigerant return and the heat exchange jacket, and a refrigerant expansion zone at an interface between the jacket passage and a refrigerant collection reservoir.

Example 8 can include, or can optionally be combined with the subject matter of Examples 1-7 to optionally include wherein the refrigerant return divides to one or more refrigerant return passages in communication with the jacket passage.

Example 9 can include, or can optionally be combined with the subject matter of Examples 1-8 to optionally include wherein the jacket passage is in communication with a refrigerant collection reservoir between the heat exchange jacket and the unit housing.

Example 10 can include, or can optionally be combined with the subject matter of Examples 1-9 to optionally include wherein the first product passage is in a first heat exchange zone between the heat exchange tube and the heat exchange jacket, refrigerant within the heat exchange tube and the heat exchange jacket is configured to refrigerate an agricultural product in the first product passage, and the second product passage is in a second heat exchange zone between the heat exchange jacket and the unit housing, and refrigerant within the heat exchange jacket is configured to refrigerate the agricultural product in the second product passage.

Example 11 can include, or can optionally be combined with the subject matter of Examples 1-10 to optionally include a heat exchanger system comprising: a heat exchange unit including: a unit housing having a product inlet and a product outlet, a first product passage extending from the product inlet to a product return, a second product passage extending from the product return to the product outlet, a heat exchange tube extending along the first product passage, the heat exchange tube including one or more heat exchange fins extending into the first product passage, a refrigerant return in communication with the heat exchange tube, and a heat exchange jacket extending along the first and second product passages, the heat exchange jacket including a jacket passage in communication with the refrigerant return; wherein the heat exchange unit is configured to cool an agricultural product in the first product passage to a first temperature with the heat exchange tube and the heat exchange jacket, and the heat exchange unit is configured to cool the agricultural product in the second product passage to a second temperature with the heat exchange jacket, the second temperature less than the first temperature; a pump in communication with the product outlet; and a distributor in communication with the pump, the distributor configured to distribute the agricultural product to an applicator.

Example 12 can include, or can optionally be combined with the subject matter of Examples 1-11 to optionally include wherein the heat exchange tube extends linearly between the heat exchange tube inlet and the refrigerant return.

Example 13 can include, or can optionally be combined with the subject matter of Examples 1-12 to optionally include wherein the one or more heat exchange fins includes a continuous helical heat exchange fin.

Example 14 can include, or can optionally be combined with the subject matter of Examples 1-13 to optionally include wherein the one or more heat exchange fins includes a first fin zone near the product inlet and a second fin zone near the product return, the first fin zone having a first spacing between turns of the one or more heat exchange fins, and the second fin zone having a second spacing between turns of the one or more heat exchange fins greater than the first spacing.

Example 15 can include, or can optionally be combined with the subject matter of Examples 1-14 to optionally include a refrigerant circuit including the heat exchange tube and the heat exchange jacket, and one or more refrigerant expansion zones are provided along the refrigerant circuit.

Example 16 can include, or can optionally be combined with the subject matter of Examples 1-15 to optionally include wherein the refrigerant circuit includes a heat exchange delivery line coupled with a heat exchange tube inlet, and the one or more refrigerant expansion zones includes a plurality of refrigerant expansion zones, the plurality of refrigerant expansion zones includes: a refrigerant expansion zone in the heat exchange delivery line, a refrigerant expansion zone at an interface of the heat exchange delivery line and the heat exchange tube inlet, a refrigerant expansion zone at an interface between the heat exchange tube and the refrigerant return, a refrigerant expansion zone at an interface between the refrigerant return and the heat exchange jacket, and a refrigerant expansion zone at an interface between the jacket passage and a refrigerant collection reservoir.

Example 17 can include, or can optionally be combined with the subject matter of Examples 1-16 to optionally include wherein the refrigerant return divides to one or more refrigerant return passages in communication with the jacket passage.

Example 18 can include, or can optionally be combined with the subject matter of Examples 1-17 to optionally include wherein the heat exchange unit is configured to cool a first ammonia vapor and liquid mixture to a second ammonia vapor and liquid mixture including a larger percentage by mass of liquid than the first ammonia vapor and liquid mixture, and the pump is configured to compress the second ammonia vapor and liquid mixture to a third ammonia liquid mixture including a larger percentage by mass of liquid than the second ammonia vapor and liquid mixture.

Example 19 can include, or can optionally be combined with the subject matter of Examples 1-18 to optionally include an applicator, the applicator including: a plurality of soil cutting tools, and a plurality of product applicators, each of the plurality of product applicators associated with a soil cutting tool of the plurality of soil cutting tools, the plurality of product applicators configured to provide the agricultural product within respective soil cuts made with the plurality of soil cutting tools.

Example 20 can include, or can optionally be combined with the subject matter of Examples 1-19 to optionally include a method for cooling an agricultural product comprising: cooling an agricultural product within a first product passage of a heat exchange unit, cooling including: turbulating the agricultural product with one or more heat exchange fins coupled along a heat exchange tube, and transferring heat from the agricultural product to a refrigerant through the one or more heat exchange fins and the heat exchange tube; and cooling the agricultural product within a second product passage of the heat exchange unit in communication with the first product passage, cooling including transferring heat from the agricultural product to the refrigerant through a heat exchange jacket.

Example 21 can include, or can optionally be combined with the subject matter of Examples 1-20 to optionally include wherein cooling the agricultural product within the first product passage includes transferring heat from the agricultural product to the refrigerant through the heat exchange jacket.

Example 22 can include, or can optionally be combined with the subject matter of Examples 1-21 to optionally include wherein turbulating the agricultural product includes disrupting fluid boundary layers along the heat exchange tube with the one or more heat exchange fins.

Example 23 can include, or can optionally be combined with the subject matter of Examples 1-22 to optionally include wherein turbulating the agricultural product includes disrupting fluid boundary layers along an interior layer of the heat exchange jacket with the one or more heat exchange fins.

Example 24 can include, or can optionally be combined with the subject matter of Examples 1-23 to optionally include wherein turbulating the agricultural product includes spinning the agricultural product within the first product passage according to a helical configuration of the one or more heat exchange fins.

Example 25 can include, or can optionally be combined with the subject matter of Examples 1-24 to optionally include wherein turbulating the agricultural product includes turbulating the agricultural product in a first fin zone near a product inlet of the heat exchange unit and a second fin zone near a product return of the heat exchange unit, the second fin zone having a second spacing between turns of the one or more heat exchange fins different than a first spacing between turns of the one or more heat exchange fins in the first fin zone.

Example 26 can include, or can optionally be combined with the subject matter of Examples 1-25 to optionally include cooling the refrigerant within the heat exchange unit, cooling the refrigerant including expanding the refrigerant through one or more refrigerant expansion zones in a refrigerant circuit extending through the heat exchange tube, a refrigerant return in communication with the heat exchange tube, and the heat exchange jacket in communication with the refrigerant return.

Example 27 can include, or can optionally be combined with the subject matter of Examples 1-26 to optionally include wherein expanding the refrigerant includes: expanding the refrigerant at a refrigerant expansion zone in a heat exchange delivery line in communication with the heat exchange tube, expanding the refrigerant at a refrigerant expansion zone at an interface of the heat exchange delivery line and the heat exchange tube, expanding the refrigerant at a refrigerant expansion zone at an interface between the heat exchange tube and the refrigerant return, expanding the refrigerant at a refrigerant expansion zone at an interface between the refrigerant return and the heat exchange jacket, and expanding the refrigerant at a refrigerant expansion zone at an interface between the heat exchange jacket and a refrigerant collection reservoir.

Example 28 can include, or can optionally be combined with the subject matter of Examples 1-27 to optionally include wherein expanding the refrigerant includes expanding the refrigerant through two or more refrigerant return passages of the refrigerant return, the two or more refrigerant return passages extending from the heat exchange tube to the heat exchange jacket.

Example 29 can include, or can optionally be combined with the subject matter of Examples 1-28 to optionally include delivering the refrigerant through the heat exchange unit including delivering refrigerant through the heat exchange tube to the heat exchange jacket through a refrigerant return.

Example 30 can include, or can optionally be combined with the subject matter of Examples 1-29 to optionally include delivering the agricultural product through the first and second product passages in the same directions as delivery of the refrigerant through the heat exchange tube to the heat exchange jacket through the refrigerant return.

Example 31 can include, or can optionally be combined with the subject matter of Examples 1-30 to optionally include wherein cooling the agricultural product within the first and second product passages includes decreasing a gas content and increasing a liquid content of the agricultural product.

Example 32 can include, or can optionally be combined with the subject matter of Examples 1-31 to optionally include compressing the agricultural product with a pump to further decrease the vapor content and increase the liquid content of the agricultural product.

Example 33 can include, or can optionally be combined with the subject matter of Examples 1-32 to optionally include applying the agricultural product after cooling, applying including: cutting soil with a plurality of soil cutting tools of an applicator, and dispensing the agricultural product within respective soil cuts made from cutting.

Example 34 can include, or can optionally be combined with the subject matter of Examples 1-33 to optionally include wherein cooling the agricultural product within the first product passage includes increasing the dwell time within the first product passage with a tortuous path provided by the one or more heat exchange fins.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein. In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A heat exchange unit comprising:

a unit housing having a product inlet, a product outlet, and a product return;

a heat exchange tube within the unit housing, the heat exchange tube including:

a heat exchange tube inlet, and one or more heat exchange fins coupled along the heat exchange tube;

a refrigerant return, the heat exchange tube extending from the heat exchange tube inlet to the refrigerant return;

a heat exchange jacket interposed between the heat exchange tube and the unit housing, the heat exchange jacket including a jacket passage in communication with the refrigerant return;

wherein a first product passage extends from the product inlet to the product return, and the heat exchange tube extends along the first product passage; and wherein a second product passage extends from the product return to the product outlet, and the jacket passage extends along the second product passage.

2. The heat exchange unit of claim 1, wherein the heat exchange tube extends linearly from the heat exchange tube inlet to the refrigerant return.

3. The heat exchange unit of claim 1, wherein the one or more heat exchange fins includes a continuous helical heat exchange fin extending between the heat exchange tube inlet and the refrigerant return.

4. The heat exchanger unit of claim 1, wherein the one or more heat exchange fins includes a first fin zone near the product inlet and a second fin zone near the product return, the first fin zone having a first spacing between a first turn of the one or more heat exchange fins, and the second fin zone having a second spacing between a second turn of the one or more heat exchange fins greater than the first spacing.

5. The heat exchange unit of claim 1, wherein the one or more heat exchange fins extend from the heat exchange tube to a position adjacent an interior layer of the heat exchange jacket, and the one or more heat exchange fins are configured to disrupt fluid boundary layers along the heat exchange tube and the interior layer of the heat exchange jacket.

6. The heat exchange unit of claim 1 comprising a refrigerant circuit including the heat exchange tube and the heat exchange jacket, and one or more refrigerant expansion zones are provided along the refrigerant circuit.

7. The heat exchange unit of claim 6, wherein the refrigerant circuit includes a heat exchange delivery line coupled with the heat exchange tube inlet, and the one or more refrigerant expansion zones includes a plurality of refrigerant expansion zones, the plurality of refrigerant expansion zones includes:

a refrigerant expansion zone in the heat exchange delivery line, a refrigerant expansion zone at an interface of the heat exchange delivery line and the heat exchange tube inlet, a refrigerant expansion zone at an interface between the heat exchange tube and the refrigerant return, a refrigerant expansion zone at an interface between the refrigerant return and the heat exchange jacket, and a refrigerant expansion zone at an interface between the jacket passage and a refrigerant collection reservoir.

8. The heat exchange unit of claim 1, wherein the refrigerant return divides to one or more refrigerant return passages in communication with the jacket passage.

9. The heat exchange unit of claim 1, wherein the jacket passage is in communication with a refrigerant collection reservoir between the heat exchange jacket and the unit housing.

10. The heat exchange unit of claim 1, wherein the first product passage is in a first heat exchange zone between the heat exchange tube and the heat exchange jacket, refrigerant within the heat exchange tube and the heat exchange jacket is configured to refrigerate an agricultural product in the first product passage, and the second product passage is in a second heat exchange zone between the heat exchange jacket and the unit housing, and refrigerant within the heat exchange jacket is configured to refrigerate the agricultural product in the second product passage.

11. A heat exchanger system comprising:

a heat exchange unit including:

a unit housing having a product inlet and a product outlet, a first product passage extending from the product inlet to a product return, a second product passage extending from the product return to the product outlet, a heat exchange tube extending along the first product passage, the heat exchange tube including one or more heat exchange fins extending into the first product passage, a refrigerant return in communication with the heat exchange tube, and a heat exchange jacket extending along the first and second product passages, the heat exchange jacket including a jacket passage in communication with the refrigerant return;

wherein the heat exchange unit is configured to cool an agricultural product in the first product passage to a first temperature with the heat exchange tube and the heat exchange jacket, and the heat exchange unit is configured to cool the agricultural product in the second product passage to a second temperature with the heat exchange jacket, the second temperature less than the first temperature;

a pump in communication with the product outlet; and a distributor in communication with the pump, the distributor configured to distribute the agricultural product to an applicator.

12. The heat exchanger system of claim 11, wherein the heat exchange tube extends linearly between the heat exchange tube inlet and the refrigerant return.

13. The heat exchanger system of claim 11, wherein the one or more heat exchange fins includes a continuous helical heat exchange fin.

14. The heat exchanger system of claim 11, wherein the one or more heat exchange fins includes a first fin zone near the product inlet and a second fin zone near the product return, the first fin zone having a first spacing between a first turn of the one or more heat exchange fins, and the second fin zone having a second spacing between a second turn of the one or more heat exchange fins greater than the first spacing.

15. The heat exchanger system of claim 11 comprising a refrigerant circuit including the heat exchange tube and the heat exchange jacket, and one or more refrigerant expansion zones are provided along the refrigerant circuit.

16. The heat exchanger system of claim 15, wherein the refrigerant circuit includes a heat exchange delivery line coupled with a heat exchange tube inlet, and the one or more refrigerant expansion zones includes a plurality of refrigerant expansion zones, the plurality of refrigerant expansion zones includes:

a refrigerant expansion zone in the heat exchange delivery line, a refrigerant expansion zone at an interface of the heat exchange delivery line and the heat exchange tube inlet, a refrigerant expansion zone at an interface between the heat exchange tube and the refrigerant return, a refrigerant expansion zone at an interface between the refrigerant return and the heat exchange jacket, and a refrigerant expansion zone at an interface between the jacket passage and a refrigerant collection reservoir.

17. The heat exchanger system of claim 11, wherein the refrigerant return divides to one or more refrigerant return passages in communication with the jacket passage.

18. The heat exchanger system of claim 11, wherein the heat exchange unit is configured to cool a first ammonia vapor and liquid mixture to a second ammonia vapor and liquid mixture including a larger percentage by mass of liquid than the first ammonia vapor and liquid mixture, and the pump is configured to compress the second ammonia vapor and liquid mixture to a third ammonia liquid mixture including a larger percentage by mass of liquid than the second ammonia vapor and liquid mixture.

19. The heat exchanger system of claim 11 comprising an applicator, the applicator including:

a plurality of soil cutting tools, and a plurality of product applicators, each of the plurality of product applicators associated with a soil cutting tool of the plurality of soil cutting tools, the plurality of product applicators configured to provide the agricultural product within respective soil cuts made with the plurality of soil cutting tools.

20. A method for cooling an agricultural product comprising:

cooling an agricultural product within a first product passage of a heat exchange unit, cooling including:

turbulating the agricultural product with one or more heat exchange fins coupled along a heat exchange tube, and transferring heat from the agricultural product to a refrigerant through the one or more heat exchange fins and the heat exchange tube; and cooling the agricultural product within a second product passage of the heat exchange unit in communication with the first product passage, cooling including transferring heat from the agricultural product to the refrigerant through a heat exchange jacket.

21. The method of claim 20, wherein cooling the agricultural product within the first product passage includes transferring heat from the agricultural product to the refrigerant through the heat exchange jacket.

22. The method of claim 20, wherein turbulating the agricultural product includes disrupting fluid boundary layers along the heat exchange tube with the one or more heat exchange fins.

23. The method of claim 22, wherein turbulating the agricultural product includes disrupting fluid boundary layers along an interior layer of the heat exchange jacket with the one or more heat exchange fins.

24. The method of claim 20, wherein turbulating the agricultural product includes spinning the agricultural product within the first product passage according to a helical configuration of the one or more heat exchange fins.

25. The method of claim 20, wherein turbulating the agricultural product includes turbulating the agricultural product in a first fin zone near a product inlet of the heat exchange unit and a second fin zone near a product return of the heat exchange unit, the second fin zone having a second spacing between a second turn of the one or more heat exchange fins different than a first spacing between a first turn of the one or more heat exchange fins in the first zone.

26. The method of claim 20 comprising cooling the refrigerant within the heat exchange unit, cooling the refrigerant including expanding the refrigerant through one or more refrigerant expansion zones in a refrigerant circuit extending through the heat exchange tube, a refrigerant return in communication with the heat exchange tube, and the heat exchange jacket in communication with the refrigerant return.

27. The method of claim 26, wherein expanding the refrigerant includes:

expanding the refrigerant at a refrigerant expansion zone in a heat exchange delivery line in communication with the heat exchange tube, expanding the refrigerant at a refrigerant expansion zone at an interface of the heat exchange delivery line and the heat exchange tube, expanding the refrigerant at a refrigerant expansion zone at an interface between the heat exchange tube and the refrigerant return, expanding the refrigerant at a refrigerant expansion zone at an interface between the refrigerant return and the heat exchange jacket, and expanding the refrigerant at a refrigerant expansion zone at an interface between the heat exchange jacket and a refrigerant collection reservoir.

28. The method of claim 26, wherein expanding the refrigerant includes expanding the refrigerant through two or more refrigerant return passages of the refrigerant return, the two or more refrigerant return passages extending from the heat exchange tube to the heat exchange jacket.

29. The method of claim 20 comprising delivering the refrigerant through the heat exchange unit including delivering refrigerant through the heat exchange tube to the heat exchange jacket through a refrigerant return.

30. The method of claim 20 comprising delivering the agricultural product through the first and second product passages in the same directions as delivery of the refrigerant through the heat exchange tube to the heat exchange jacket through the refrigerant return.

31. The method of claim 20, wherein cooling the agricultural product within the first and second product passages includes decreasing a gas content and increasing a liquid content of the agricultural product.

32. The method of claim 31 comprising compressing the agricultural product with a pump to further decrease the vapor content and increase the liquid content of the agricultural product.

33. The method of claim 20 comprising applying the agricultural product after cooling, applying including:

cutting soil with a plurality of soil cutting tools of an applicator, and dispensing the agricultural product within respective soil cuts made from cutting.

34. The method of claim 20, wherein cooling the agricultural product within the first product passage includes increasing the dwell time within the first product passage with a tortuous path provided by the one or more heat exchange fins.

* * * * *